US008967775B2

(12) United States Patent
Arai et al.

(10) Patent No.: US 8,967,775 B2
(45) Date of Patent: Mar. 3, 2015

(54) INK JET HEAD AND IMAGE FORMING APPARATUS

(71) Applicant: Toshiba Tec Kabushiki Kaisha, Tokyo (JP)

(72) Inventors: Ryuichi Arai, Shizuoka-ken (JP); Chiaki Tanuma, Tokyo (JP); Ryutaro Kusunoki, Shizuoka-ken (JP); Shuhei Yokoyama, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/015,811

(22) Filed: Aug. 30, 2013

(65) Prior Publication Data

US 2014/0063131 A1 Mar. 6, 2014

(30) Foreign Application Priority Data

Aug. 31, 2012 (JP) ..... 2012-192550

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/1621* (2013.01); *B41J 2/14233* (2013.01); *B41J 2/1433* (2013.01); *B41J 2002/14475* (2013.01); *B41J 2202/15* (2013.01)
USPC ..... 347/71

(58) Field of Classification Search
CPC ..... B41J 2/161; B41J 2/04581; B41J 2002/1425; B41J 2/1433; B41J 2/1607; H01L 41/04
USPC ..... 347/68, 70–72; 29/25.35
See application file for complete search history.

(56) References Cited

U.S. PATENT DOCUMENTS 6,474,786 B2 * 11/2002 Percin et al. ..... 347/54
6,712,455 B2 * 3/2004 Dante ..... 347/68

(Continued)

FOREIGN PATENT DOCUMENTS

JP H02-103152 A 4/1990
JP 2002-359981 A 12/2002

(Continued)

OTHER PUBLICATIONS

U.S. Appl. No. 13/864,535, Yokoyama et al., titled "Ink Jet Head and Manufacturing Method of the Same," filed Apr. 17, 2013.

(Continued)

*Primary Examiner* — An Do
(74) *Attorney, Agent, or Firm* — Patterson & Sheridan LLP

(57) ABSTRACT

An ink jet head includes a substrate including a mounting surface and a pressure chamber open to the mounting surface. The ink jet head further includes a nozzle plate including an inner surface fixed to the mounting surface and covering the pressure chamber, a nozzle open to the pressure chamber, and a piezoelectric element surrounding the nozzle and configured to deform to thereby change a volume of the pressure chamber. The ink jet head further includes a deformation control unit disposed on and extending from the inner surface of the nozzle plate and surrounding the nozzle, the deformation control unit configured to cause deformation of the piezoelectric element to be substantially symmetric with respect to the nozzle.

20 Claims, 8 Drawing Sheets

(56) References Cited

U.S. PATENT DOCUMENTS

| | | | | |
|---|---|---|---|---|
| 8,042,916 | B2 * | 10/2011 | Wang | 347/70 |
| 2002/0008741 | A1 | 1/2002 | Temple et al. | |
| 2012/0056947 | A1 | 3/2012 | Tanuma et al. | |
| 2013/0222481 | A1 | 8/2013 | Yokoyama et al. | |
| 2013/0222484 | A1 | 8/2013 | Yokoyama et al. | |

FOREIGN PATENT DOCUMENTS

| | | | |
|---|---|---|---|
| JP | 2003-524542 | A | 8/2003 |
| JP | 2012-096501 | A | 5/2012 |
| JP | 2013-067026 | | 4/2013 |

OTHER PUBLICATIONS

U.S. Appl. No. 13/786,311, Yokoyama et al., titled "Ink-Jet Head and Manufacturing Method of the Same," filed Mar. 5, 2013.

Japanese Office Action, Patent Application No. 2012-192550, dated May 13, 2014.

* cited by examiner

INK JET HEAD AND IMAGE FORMING APPARATUS

CROSS-REFERENCE TO RELATED APPLICATION

This application is based upon and claims the benefit of priority from Japanese Patent Application No. 2012-192550; filed on Aug. 31, 2012, the entire contents of which are incorporated herein by reference.

FIELD

Embodiments described herein relate generally to an ink jet head and an image forming device.

BACKGROUND

On-demand type ink jet recording methods are known in which discharge ink droplets are discharged from a nozzle according to an image signal to form an image on a recording paper. In connection with the on-demand type ink jet recording method, a heating element type ink jet recording method and a piezoelectric element type ink jet recording method are known.

In the heating element type ink jet recording method, air bubbles are generated in ink by heat provided by a heat source in an ink flow channel. The ink pressed by the air bubbles is discharged from a nozzle.

In the piezoelectric element type ink jet recording method, a pressure change occurs in an ink chamber, where ink is stored, due to the deformation of a piezoelectric element. Thus the ink is discharged from a nozzle.

A piezoelectric element is an electromechanical conversion element, undergoes expansion or shear deformation when an electric field is applied thereto. Lead zirconate titanate is used as a representative piezoelectric element.

With respect to an ink jet head using a piezoelectric element, a configuration using a nozzle plate formed of a piezoelectric material is known. The nozzle plate of the ink jet head includes an actuator. The actuator includes, for example, a piezoelectric film having a nozzle for discharging ink, and a metal electrode film formed on both surfaces of the piezoelectric film surrounding the nozzle.

The ink jet head includes a pressure chamber that is connected to the nozzle. Ink enters the pressure chamber and the nozzle of the nozzle plate and forms a meniscus within the nozzle, and thus the ink is maintained within the nozzle. When a driving waveform (voltage) is applied to the two electrodes provided around the nozzle on either side of the piezoelectric film, an electric field in the same direction as a polarization direction is applied to the piezoelectric film through the electrodes. Thereby, the actuator expands and contracts in a direction perpendicular to the direction of the electric field. The nozzle plate deforms by virtue of the expansion and the contraction of the actuator. A pressure change occurs in the ink within the pressure chamber due to the deformation of the nozzle plate, and thus the ink within the nozzle is discharged.

When a nozzle plate is formed, film stress occurs. There is a concern that a uniform deformation of the nozzle plate through an actuator may be obstructed by the film stress of the nozzle plate. When the deformation of the nozzle plate becomes non-uniform, there is a concern that a discharge direction of ink may become unstable.

DETAILED DESCRIPTION

An ink jet head according to an embodiment comprises a substrate including amounting surface and a pressure chamber open to the mounting surface. The ink jet head further comprises a nozzle plate including an inner surface fixed to the mounting surface and covering the pressure chamber, a nozzle open to the pressure chamber, and a piezoelectric element surrounding the nozzle and configured to deform to thereby change a volume of the pressure chamber. The ink jet head further comprises a deformation control unit disposed on and extending from the inner surface of the nozzle plate and surrounding the nozzle, the deformation control unit configured to cause deformation of the piezoelectric element to be substantially symmetric with respect to the nozzle.

Hereinafter, a first embodiment will be described with reference to FIG. 1 through FIG. 5.

Figure 1:
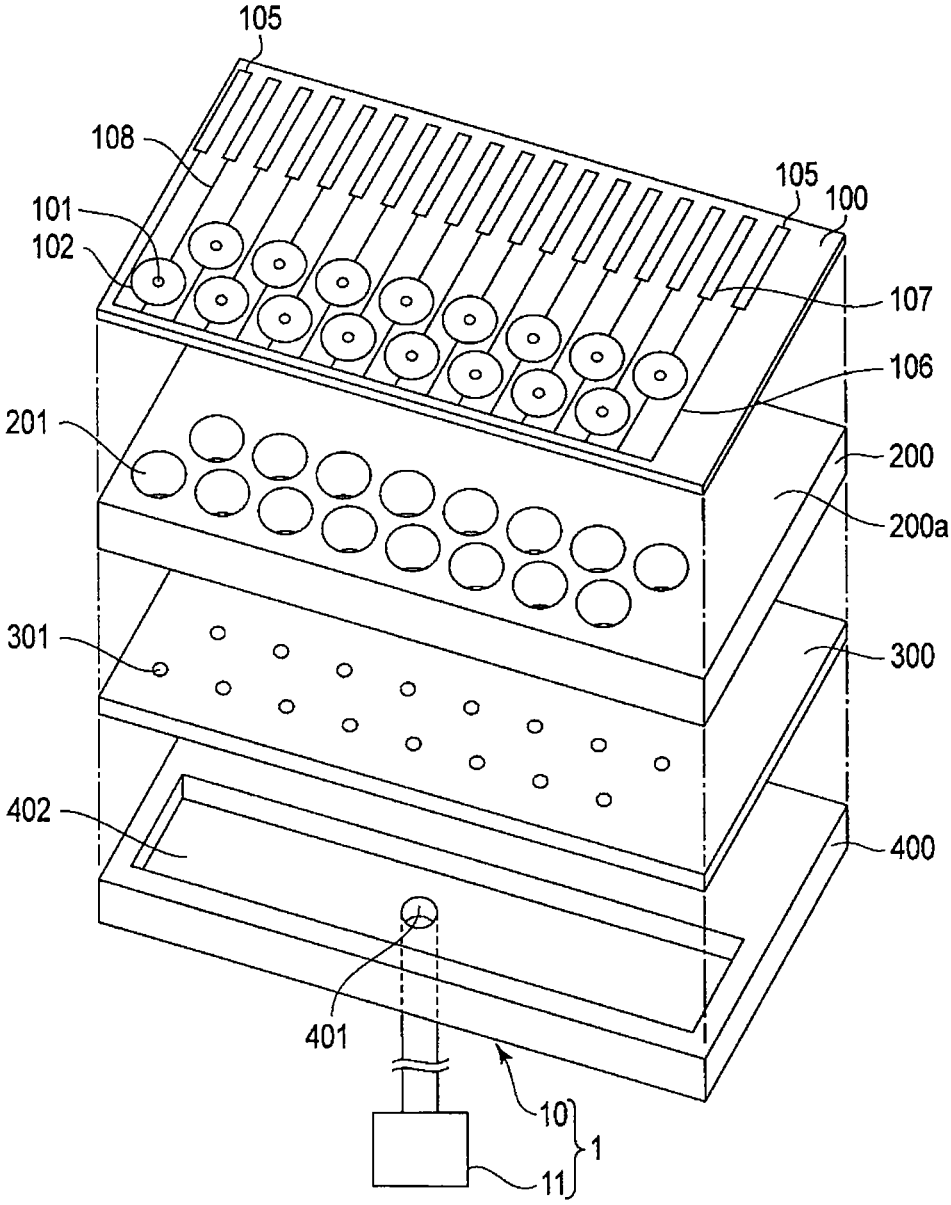
FIG. 1 is an exploded perspective view of an ink jet head of an ink jet printer, according to a first embodiment.
Figure 2:
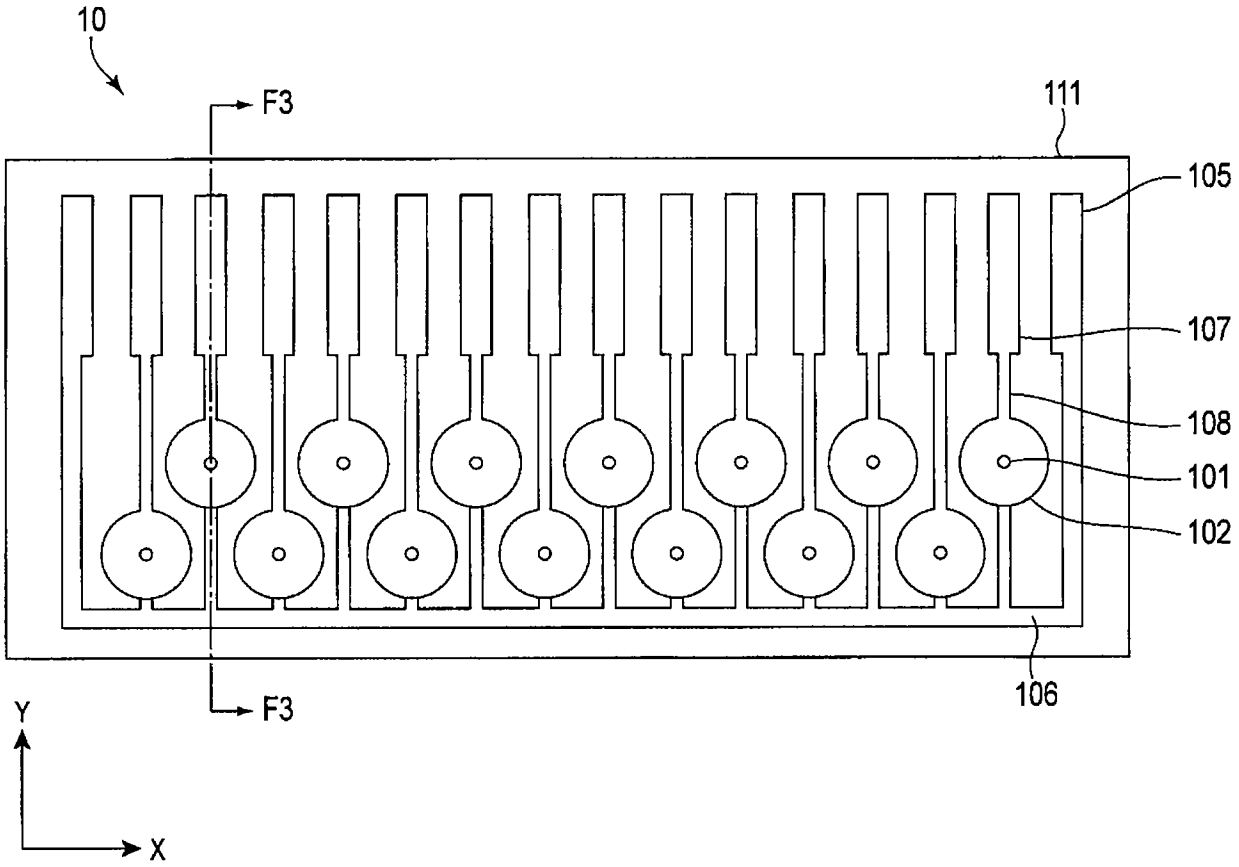
FIG. 2 is a plane view of the ink jet head according to the first embodiment.
Figure 3:
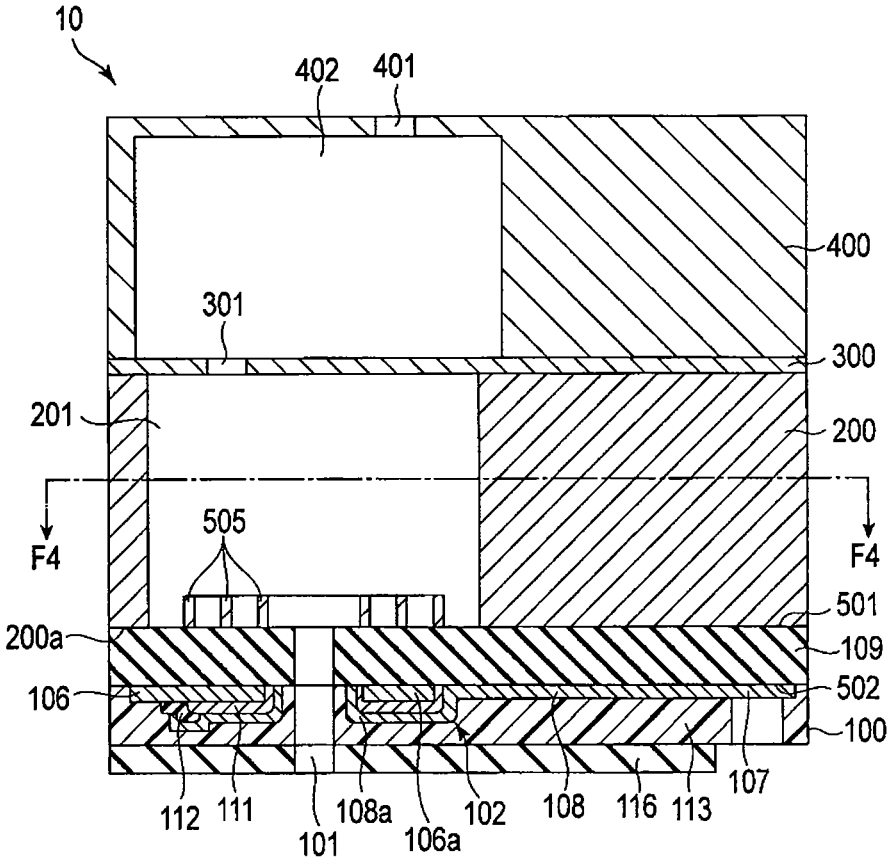
FIG. 3 is a cross-sectional view of the ink jet head of the first embodiment taken along line F3-F3 of FIG. 2.

FIG. 1 is an exploded perspective view of an ink jet head 10 of an ink jet printer 1 according to a first embodiment. FIG. 2 is a plane view of the ink jet head 10. FIG. 3 is a schematic cross-sectional view of the ink jet head 10 taken along line F3-F3 of FIG. 2.

As shown in FIG. 1, the ink jet head 10 is mounted on the ink jet printer 1. The ink jet printer 1 is an example of an image forming device. The image forming device is not limited thereto, and may be any other image forming device such as a copy machine.

The ink jet head 10 includes a nozzle plate 100, a pressure chamber structure 200, a separate plate 300, and an ink feed passage structure 400. The pressure chamber structure 200 can be formed from a substrate. The pressure chamber structure 200, the separate plate 300, and the ink feed passage structure 400 are joined with, for example, an epoxy-based adhesive.

The nozzle plate 100 is formed in a rectangular plate shape. The nozzle plate 100 is formed on the pressure chamber structure 200 by using a film-forming process, described below. As a result of the film-forming process, the nozzle plate 100 is firmly fixed to the pressure chamber structure 200.

A plurality of nozzles 101 for discharging ink are provided in the nozzle plate 100. Each nozzle 101 is a circular hole that extends through the nozzle plate 100 in the thickness direction.

The pressure chamber structure 200 is formed of a silicon wafer having a rectangular plate shape. The thickness of the pressure chamber structure 200 is, for example, 725 μm. Heating and thin-film formation are repeatedly performed on the pressure chamber structure 200 during a manufacturing process of the ink jet head 10. For this reason, the silicon wafer has a heat resistance property and is smoothed according to an SEMI (Semiconductor Equipment and Materials International) standard. However, the pressure chamber structure 200 is not limited to the above description, and may be formed of any of other semiconductors such as a silicon carbide (SiC) germanium substrate.

The pressure chamber structure 200 includes a mounting surface 200*a* that faces the nozzle plate 100, and a plurality of pressure chambers 201. The nozzle plate 100 is firmly fixed to the mounting surface 200*a*.

The pressure chamber 201 is comprised of a circular hole, for example having a diameter of 240 μm. However, the pressure chamber 201 may be a hole having any of other shapes such as a rectangular shape or a rhombic shape. The pressure chambers 201 open on the mounting surface 200*a* and are covered by the nozzle plate 100.

The plurality of pressure chambers 201 are arranged to correspond to the plurality of nozzles 101, and are disposed coaxially with the plurality of nozzles 101, respectively. For this reason, each nozzle 101 is in direct communication with a corresponding pressure chamber 201.

The separate plate 300 is formed of stainless steel having a rectangular plate shape. The separate plate 300 covers the plurality of pressure chambers 201 on the side opposite of the nozzle plate 100.

A plurality of ink apertures 301 are provided in the separate plate 300. Each of the plurality of ink apertures 301 are disposed so as to respectively correspond to one of the pressure chambers 201. For this reason, each ink aperture 301 opens in one of the pressure chambers 201. The ink apertures 301 are formed such that the ink flow path resistance to each of the respective pressure chambers 201 is approximately the same.

The ink feed passage structure 400 is formed of stainless steel having a rectangular plate shape. The ink feed passage structure 400 includes an ink supply port 401 and an ink supply passage 402.

The ink supply port 401 is disposed in a central portion of the ink supply passage 402. The ink supply port 401 is connected to an ink tank 11 in which ink for forming an image is stored. The ink tank 11 supplies the ink to the ink supply passage 402.

The ink supply passage 402 is recessed from the surface of the ink feed passage structure 400, and extends outwardly beyond the perimeter of the array of ink apertures 301. In other words, each of the ink apertures 301 open into the ink supply passage 402. Thus, the ink supply port 401 supplies ink to all the pressure chambers 201 through the ink apertures 301. In addition, the ink supply port 401 is formed such that the ink flow path resistance to each of the respective pressure chambers 201 is approximately the same.

As described above, the separate plate 300 and the ink feed passage structures 400 may be formed of stainless steel. However, the materials of such components are not limited to stainless steel. The separate plate 300 and the ink feed passage structure 400 may be formed of any of other materials such as a ceramic, a resin, or a metal alloy so long as a difference in expansion coefficient between the separate plate 300 and the ink feed passage structure 400 on the one hand, and the nozzle plate 100, on the other hand does not affect the generation of ink discharge pressure. The ceramic used may be a nitride or an oxide such as alumina ceramic, zirconia, silicon carbide, silicon nitride, or barium titanate. The resin used may be a plastic material such as ABS (acrylonitrile.butadiene.styrene), polyacetal, polyamide, polycarbonate, or polyethersulfone. The metal used may be, for example, aluminum or titanium.

The pressure chamber 201 holds the supplied ink. When a pressure change occurs in the ink within each pressure chamber 201 by the deformation of the nozzle plate 100, the ink within the pressure chamber 201 is discharged from each nozzle 101. The separate plate 300 confines pressure generated within the pressure chambers 201 so as to prevent the pressure from escaping to the ink supply passage 402. For this reason, the diameter of the ink aperture 301 is, for example, equal to or less than ¼ of the diameter of the pressure chamber 201.

Next, the nozzle plate 100 will be described. As shown in FIG. 2, the nozzle plate 100 includes the above-mentioned plurality of nozzles 101, a plurality of actuators 102, two shared electrode terminal portions 105, a shared electrode 106, a plurality of wiring electrode terminal portions 107, and a plurality of wiring electrodes 108. As shown in FIG. 3, the nozzle plate 100 further includes a vibration plate 109, a protective film 113, and an ink-repellent film 116. The actuator 102 is an example of a piezoelectric element.

The vibration plate 109 has a rectangular shape and is formed on the mounting surface 200*a* of the pressure chamber structure 200. The vibration plate 109 includes a first surface 501 and a second surface 502. The first surface 501 is an example of an inner surface of the nozzle plate.

The first surface 501 is firmly fixed to the mounting surface 200*a* of the pressure chamber 200 and covers the pressure chambers 201, except in the location of the nozzle 101 extending therethrough. The second surface 502 is located on the opposite side of the first surface 501. The actuators 102, the shared electrode 106, and the wiring electrodes 108 are formed on the second surface 502 of the vibration plate 109.

The plurality of actuators 102 are arranged so that each corresponds to one of the plurality of pressure chambers 201 and one of the plurality of nozzles 101. The actuator 102 generates pressure for discharging ink in the pressure chamber 201 from the nozzle 101.

As shown in FIG. 2, the actuator 102 is formed in an annular shape. The actuator 102 is disposed coaxially with the corresponding nozzle 101. In other words, the center of the actuator 102 and the center of the nozzle 101 are aligned. The actuator 102 surrounds the nozzle 101. However, the center of the actuator 102 and the center of the nozzle 101 may deviate from each other.

In order to arrange the nozzles 101 with higher density, the nozzles 101 are disposed in a zigzag shape. In other words, the plurality of nozzles 101 are arranged linearly in an X-axis direction of FIG. 2. Two aligned rows of the nozzles 101 are provided in a Y-axis direction.

As shown in FIG. 3, the actuator 102 includes a piezoelectric film 111, an electrode portion 106*a* of the shared electrode 106, an electrode portion 108*a* of the wiring electrode 108, and an insulating film 112.

The piezoelectric film 111 may be formed of lead zirconate titanate (PZT) in a film shape. The piezoelectric film 111 is not limited to that material, and may be formed of any of various materials such as PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, and AlN.

The piezoelectric film 111 is formed in an annular shape. The piezoelectric film 111 is disposed coaxially with the nozzle 101 and the pressure chamber 201. In other words, the piezoelectric film 111 surrounds the nozzle 101. An inner circumferential portion of the piezoelectric film 111 is slightly separated from the nozzle 101.

The piezoelectric film 111 is sandwiched between the electrode portion 108*a* of the wiring electrode 108 and the electrode portion 106*a* of the shared electrode 106. In other words, the electrode portion 108*a* of the wiring electrode 108 and the electrode portion 106*a* of the shared electrode 106 are disposed on either side of the piezoelectric film 111.

The formed piezoelectric film 111 generates polarization in the thickness direction. When an electric field is applied to the piezoelectric film 111 in the same direction as the polarization direction through the wiring electrode 108 and the shared electrode 106, the actuator 102 expands and contracts in a direction perpendicular to the direction of the electric field. The vibration plate 109 is deformed in the thickness direction of the nozzle plate 100 by the expansion and the contraction of the actuator 102. The capacity of the pressure chamber 201 is changed, and a pressure change occurs in the ink within the pressure chamber 201.

The electrode portion 108*a* of the wiring electrode 108 is one of two electrodes connected to the opposed sides of the piezoelectric film 111. The electrode portion 108*a* of the wiring electrode 108 is formed in an annular shape larger than that of the piezoelectric film 111, and is formed on the discharge side (the side facing the outside of the ink jet head 10) of the piezoelectric film 111.

The electrode portion 106*a* of the shared electrode 106 is one of the two electrodes connected to the piezoelectric film 111. The electrode portion 106*a* of the shared electrode 106 is formed in an annular shape smaller than that of the piezoelectric film 111, and is formed on the second surface 502 of the vibration plate 109. The electrode portion 106*a* of the shared electrode 106 is formed on the second surface 502 of the vibration plate 109.

The insulating film 112 is sandwiched between the shared electrode 106 and the wiring electrode 108 on the outside of a region in which the piezoelectric film 111 is formed. That is, the shared electrode 106 and the wiring electrode 108 are insulated from each other by the piezoelectric film 111 or the insulating film 112. The insulating film 112 may be formed of, for example, $SiO_2$ (silicon oxide). The insulating film 112 may be formed of any of other materials.

A driving circuit is connected to the shared electrode terminal portions 105 and the wiring electrode terminal portions 107. The driving circuit may be, for example, a flexible printed circuit board or a tape carrier package (TCP).

The wiring electrode terminal portion 107 is provided at an end of the wiring electrode 108. The wiring electrode terminal portion 107 is connected to the driving circuit and transmits a signal for driving the actuator 102.

As shown in FIG. 2, an interval between the wiring electrode terminal portions 107 is the same as an interval between the nozzles 101 in the X-axis direction. The width of the wiring electrode terminal portion 107 in the X-axis direction is wider than the width of the wiring electrode 108. For this reason, the wiring electrode terminal portion 107 is easily connected to the driving circuit.

For example, the shared electrode terminal portions 105 are provided on the second surface 502 of the vibration plate 109. The shared electrode terminal portion 105 is an end of the shared electrode 106 and is connected to a GND (ground=0 V) provided in the driving circuit.

The wiring electrodes 108 are each individually connected to the piezoelectric films 111 of the corresponding actuators 102 and each transmit a signal for driving the respective actuators 102. Each wiring electrode 108 is used as an individual electrode for operating the piezoelectric film 111 independently of other piezoelectric films 111 on the nozzle plate 100. Each of the plurality of wiring electrodes 108 includes the above-mentioned electrode portion 108*a*, a wiring portion, and the above-mentioned wiring electrode terminal portion 107.

The wiring portion of the wiring electrode 108 extends toward the wiring electrode terminal portion 107 from the electrode portion 108*a*. The electrode portion 108*a* of the wiring electrode 108 is disposed coaxially with the nozzle 101. An inner circumferential portion of the electrode portion 108*a* is slightly separated from the nozzle 101.

The wiring electrodes 108 are formed of, for example, a Pt (platinum) thin film. However, the wiring electrodes 108 may be formed of any of other materials such as Ni (nickel), Cu (copper), Al (aluminum), Ag (silver), Ti (titanium), W (tantalum), No (molybdenum), or Au (gold).

The shared electrode 106 is connected to the plurality of piezoelectric films 111. The shared electrode 106 includes the above-mentioned plurality of electrode portions 106*a*, a plurality of wiring portions, and the above-mentioned two shared electrode terminal portions 105.

The wiring portion of the shared electrode 106 extends from the electrode portion 106*a* to the opposite side of the wiring portion of the wiring electrode 108. The wiring portions of the shared electrode 106 join at an end of the nozzle plate 100 in the Y-axis direction shown in FIG. 2, and extend to both ends of the nozzle plate 100 in the X-axis direction. The electrode portion 106*a* is provided coaxially around the nozzle 101. An inner circumferential portion of the electrode portion 106*a* is spaced separated from the outer circumference of nozzle 101. The shared electrode terminal portions 105 are respectively disposed at opposed ends of the nozzle plate 100 in the X-axis direction.

The shared electrode 106 may be formed of, for example, a Pt (platinum)/Ti (titanium) thin film. However, the shared electrode 106 may be formed of any of other materials such as Ni, Cu, Al, Ti, W, Mo, or Au.

As shown in FIG. 3, the protective film 113 is provided on the second surface 502 of the vibration plate 109. The protective film 113 covers the second surface 502 of the vibration plate 109, the shared electrode 106, the wiring electrode 108, and the piezoelectric film 111.

The protective film 113 may be formed of polyimide. The protective film 113 is not limited thereto, and may be formed of any of other materials such as a resin, a ceramic, or a metal (alloy). The resin used is a plastic material such as ABS (acrylonitrile.butadiene.styrene), polyacetal, polyamide, polycarbonate, or polyethersulfone. The ceramic used is a nitride or an oxide such as zirconia, silicon carbide, silicon nitride, or barium titanate. The metal used is, for example, aluminum, SUS, or titanium. Meanwhile, when the protective film 113 is formed of a conductive material, the shared electrode 106, the wiring electrode 108, and the piezoelectric film 111 are insulated from each other, for example, by a resin.

The material of the protective film 113 has a Young's modulus that is greatly different from that of the material of the vibration plate 109. A deformation amount of a plate shape is affected by the Young's modulus and a plate thickness of a material. Even when the same force is applied, the deformation amount increases as the Young's modulus decreases and the plate thickness decreases.

The ink-repellent film 116 covers the surface of the protective film 113. The ink-repellent film 116 may be formed of a silicone-based water repellent material with a water repellent property. However, the ink-repellent film 116 may be formed of any of other materials such as a fluoride-containing organic material.

The ink-repellent film 116 does not cover the shared electrode terminal portions 105, the wiring electrode terminal portions 107, and the protective film 113 around the shared electrode terminal portions 105 and the wiring electrode terminal portions 107, so as to expose such components.

The nozzles 101 extend through the vibration plate 109, the protective film 113, and the ink-repellent film 116. In other words, the nozzles 101 are provided in the vibration plate 109, the protective film 113, and the ink-repellent film 116.

The vibration plate 109 may be formed of $SiO_2$. However, the vibration plate 109 is not limited thereto, and may be formed of any of other materials such as SiN (silicon nitride), $Al_2O_3$ (aluminum oxide), $HfO_2$ (hafnium oxide), $ZrO_2$ (zirconium oxide), or DLC (Diamond Like Carbon).

The material of the vibration plate 109 is selected in consideration of, for example, a heat resistance property, an insulation property (e.g., when ink with high conductivity is used, the influence of ink alteration due to the driving of the actuator 102 is considered), an expansion coefficient, smoothness, and wettability with respect to ink.

As shown in FIG. 3, a plurality of deformation control units 505 are provided in the pressure chamber 201. However, only one deformation control unit 505 may be provided in the pressure chamber 201. The deformation control units 505 protrude from the first surface 501 of the vibration plate 109 of the nozzle plate 100.

The deformation control units 505 are now further described, with reference to a single deformation control unit 505. The description is applicable to each of the plurality of deformation control units 505, if more than one deformation control unit 505 is provided. The deformation control unit 505 is formed of silicon which is the same material as the pressure chamber structure 200. However, the deformation control unit 505 may be formed of a different material from the pressure chamber structure 200. In addition, the deformation control unit 505 may be formed out of a portion of the vibration plate 109.

Figure 4:
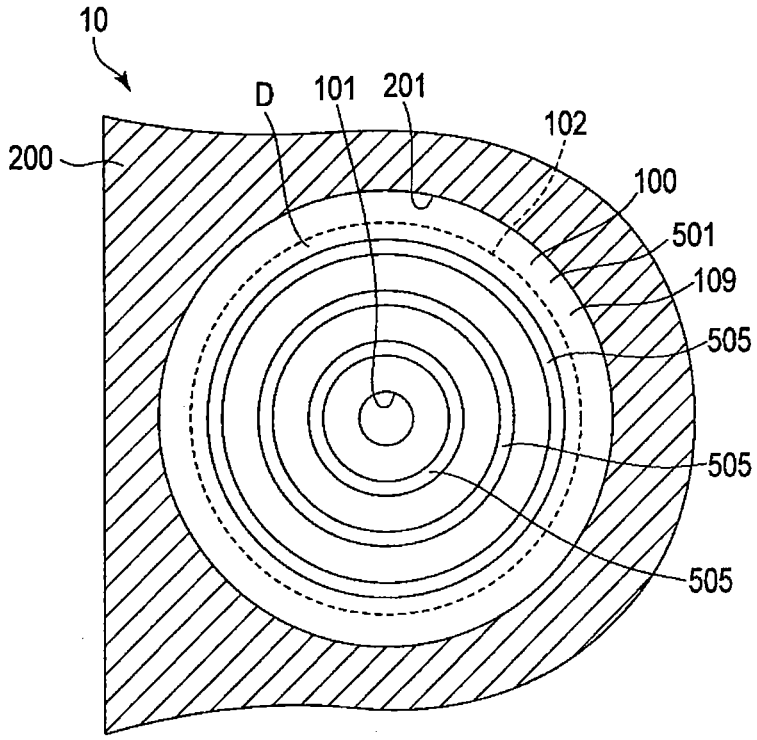
FIG. 4 is a cross-sectional view of a part of the ink jet head of the first embodiment taken along line F4-F4 of FIG. 3.

FIG. 4 is a cross-sectional view of a part of the ink jet head 10 taken along line F4-F4 of FIG. 3. As shown in FIG. 4, the deformation control unit 505 is formed in an annular shape. The deformation control unit 505 is disposed coaxially with the nozzle 101. In other words, the deformation control unit 505 surrounds the nozzle 101 so that the center of the deformation control unit 505 and the center of the nozzle 101 are substantially the same. However, the center of the deformation control unit 505 and the center of the nozzle 101 may deviate from each other.

The deformation control unit 505 is disposed at a position overlapping the actuator 102 on the nozzle plate 100. In other words, the deformation control unit 505 is disposed inside a region D on the nozzle plate that is defined by an outer edge of the actuator 102. An external diameter of the actuator 102 having an annular shape is, for example, 174 μm.

A distance between an inner edge of the deformation control unit 505 and an outer edge thereof is smaller than a distance between an inner edge of the actuator 102 and the outer edge thereof. In other words, an annular width of the deformation control unit 505 is smaller than an annular width of the actuator 102. The annular width of the deformation control unit 505 is, for example, 10 μm to 30 μm. The annular width of the deformation control unit 505 is, for example, 10 μm to 100 μm.

Considering the plurality of deformation control units 505, the deformation control unit 505 on the innermost side of the nozzle plate 100 is separated from the nozzle 101. The plurality of deformation control units 505 are arranged at equal intervals. However, the innermost deformation control unit 505 may be adjacent to the nozzle 101. Also, the deformation control units 505 may be arranged at different intervals.

The above-described inkjet printer 1 performs printing (i.e., image formation) as follows. Ink is supplied to the ink supply port 401 of the ink feed passage structure 400 from the ink tank 11. The ink is supplied to the plurality of pressure chambers 201 via the plurality of ink apertures 301. The ink supplied to the pressure chamber 201 is then supplied into the corresponding nozzle 101 and forms a meniscus in the nozzle 101. The ink supplied from the ink supply port 401 is held with an appropriate negative pressure, so that the ink within the nozzle 101 is held without leaking from the nozzle 101.

A printing instruction signal is input to the driving circuit, for example, by a user's operation. The driving circuit that received the printing instruction outputs the signal to the actuator 102 through the wiring electrode 108. In other words, the driving circuit applies a voltage to the electrode portion 108*a* of the wiring electrode 108. Thereby, an electric field is applied to the piezoelectric film 111 in the same direction as a polarization direction, and the actuator 102 expands and contracts in a direction perpendicular to the direction of the electric field.

The actuator 102 is sandwiched between the vibration plate 109 and the protective film 113. Thus, when the actuator 102 extends in the direction perpendicular to the direction of the electric field, force for deforming in a concave shape with respect to the pressure chamber 201 side is applied to the vibration plate 109. Furthermore, a force for deforming in a convex shape with respect to the pressure chamber 201 side is applied to the protective film 113. When the actuator 102 contracts in the direction perpendicular to the direction of the electric field, a force for deforming in a convex shape with respect to the pressure chamber 201 side is applied to the vibration plate 109. In addition, a force for deforming in a concave shape with respect to the pressure chamber 201 side is applied to the protective film 113.

Figure 5:
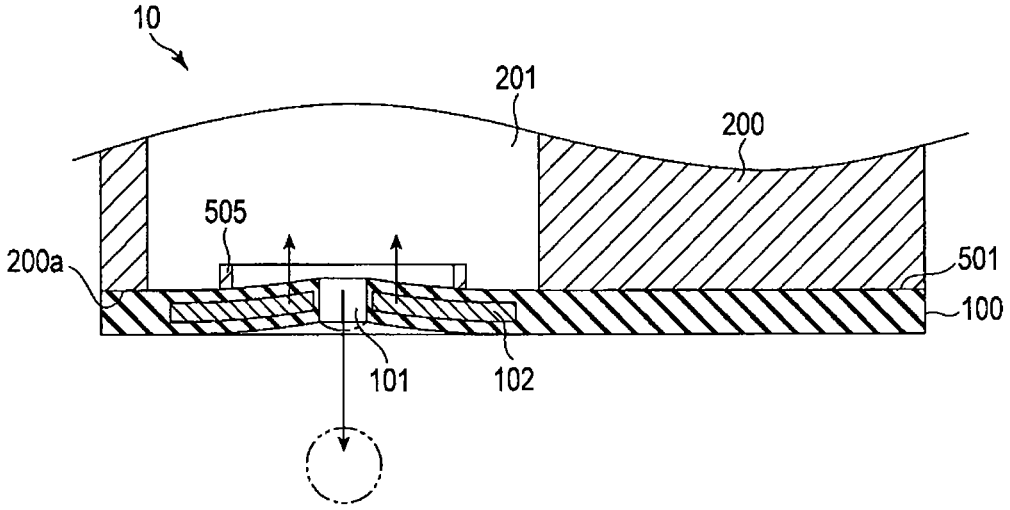
FIG. 5 is a cross-sectional view of a part of an ink jet head of the first embodiment in which a nozzle plate is deformed.

FIG. 5 is a cross-sectional view of a part of the ink jet head 10 in which the nozzle plate 100 is deformed. In FIG. 5, the nozzle plate 100 and the actuator 102 are shown. In addition, FIG. 5 shows only one deformation control unit 505, although, as explained above, more than one may be used.

The polyimide film of the protective film 113 has a Young's modulus smaller than that of the vibration plate 109. For this reason, the protective film 113 has a greater deformation amount with respect to the same force. When the actuator 102 extends in the direction perpendicular to the direction of the electric field, the nozzle plate 100 is deformed in a convex shape with respect to the pressure chamber 201 side, as shown in FIG. 5. Thereby, the capacity of the pressure chamber 201 is reduced because the protective film 113 has a greater deformation amount in a convex shape with respect to the pressure chamber 201 side. Conversely, when the actuator 102 contracts in the direction perpendicular to the direction of the electric field, the nozzle plate 100 is deformed in a concave shape with respect to the pressure chamber 201 side. Thereby, the capacity of the pressure chamber 201 is increased because the protective film 113 has a greater deformation amount in a concave shape with respect to the pressure chamber 201 side. In this manner, the actuator 102 changes the capacity of the pressure chamber 201 by deforming the nozzle plate 100.

When the volume of the pressure chamber 201 is increased or reduced by the deformation of the nozzle plate 100, a pressure change occurs in the ink of the pressure chamber 201. The ink supplied to the nozzles 101 is discharged by the pressure change. In FIG. 5, the discharged ink droplets are shown as a dashed-two dotted line.

As a difference in the Young's modulus between the vibration plate 109 and the protective film 113 increases, a difference in deformation amount of the vibration plate 109 when the same voltage is applied to the actuator 102 increases. For this reason, as the difference in the Young's modulus between the vibration plate 109 and the protective film 113 increases, ink can be discharged at a lower voltage.

When a voltage is applied to the actuator 102 in a case where the vibration plate 109 and the protective film 113 have the same film thickness and Young's modulus, forces that cause the deformation by the same amount in the directly opposite directions are applied to the vibration plate 109 and the protective film 113, and thus the vibration plate 109 is not deformed.

Meanwhile, as described above, a deformation amount of a plate is affected by not only the Young's modulus of a material but also a plate thickness. For this reason, when a difference occurs in the deformation amount between the vibration plate 109 and the protective film 113, both the Young's modulus of each material and the film thicknesses of each material are considered. Even when the materials of the vibration plate 109 and the protective film 113 have the same Young's modulus, if there is a difference between the film thicknesses, ink can be discharged.

Next, an example of a method of manufacturing the ink jet head 10 will be described. First, the vibration plate 109 is formed in the pressure chamber structure 200 (which is formed from a silicon wafer) before the pressure chamber 201 is formed. The $SiO_2$ film for forming the vibration plate 109 is formed on the entirety of the mounting surface 200*a* of the pressure chamber structure 200 by using, for example, a CVD method. The $SiO_2$ film may also be formed by thermal oxidation. In addition, if the vibration plate 109 is formed of SiN, the vibration plate may be formed using a sputtering method.

Next, the vibration plate 109 is patterned to form the nozzles 101. The patterning is performed by forming an etching mask on the vibration plate 109 and removing the unmasked portions of the vibration plate 109 through etching.

Next, the shared electrode 106 is formed on the second surface 502 of the vibration plate 109. For example, Ti and Pt are sequentially deposited using a sputtering method. The shared electrode 106 may be formed by any of other manufacturing methods such as deposition or plating.

After the shared electrode 106 is formed, the plurality of electrode portions 106*a*, the wiring portion, and the two shared electrode terminal portions 105 are formed through patterning. The patterning is performed by forming an etching mask on an electrode film and removing the unmasked portions of electrode material through etching.

Since the nozzle 101 is formed at the center of the electrode portion 106*a* of the shared electrode 106, a portion of the electrode portion 106*a* having no electrode film, concentric with the center of the electrode portion 106*a*, is formed. The shared electrode 106 is patterned, and thus the vibration plate 109 is exposed at positions other than at the electrode portion 106*a* of the shared electrode 106, the wiring portion, and the shared electrode terminal portion 105.

Next, the piezoelectric film 111 is formed on the shared electrode 106. The piezoelectric film 111 is formed using, for example, an RF magnetron sputtering method. After the formation of the piezoelectric film, the piezoelectric film 111 is heated at a temperature of 500° C. for three hours in order to impart piezoelectricity to the piezoelectric film 111. Thereby, the piezoelectric film 111 obtains a good piezoelectric performance. The piezoelectric film 111 may be formed using any of various manufacturing methods such as a CVD (chemical vapor deposition) method, a sol-gel method, an AD (aerosol deposition) method, or a hydrothermal synthesis method. The piezoelectric film 111 is patterned by etching.

Since the nozzle 101 is formed at the center of the piezoelectric film 111, a portion having no piezoelectric film is formed which is concentric with the nozzle 101. The vibration plate 109 is exposed in the portion not including the piezoelectric film 111. The piezoelectric film 111 covers the electrode portion 106*a* of the shared electrode 106.

Next, the insulating film 112 is formed on a part of the piezoelectric film 111 and apart of the shared electrode 106. The insulating film 112 is formed using a CVD method capable of realizing a good insulation property through low-temperature film formation. The insulating film 112 is patterned after the film formation. In order to prevent defects from occurring due to patterning process variations, the insulating film 112 covers a part of the piezoelectric film 111. The insulating film 112 covers the piezoelectric film 111 to the extent that a deformation amount of the piezoelectric film 111 is not obstructed.

Next, the wiring electrode 108 is formed on the vibration plate 109, the piezoelectric film 111, and the insulating film 112. The wiring electrode 108 may be formed using a sputtering method. The wiring electrode 108 may also be formed using any of various manufacturing methods such as vacuum deposition or plating.

The electrode portion 108*a*, the wiring portion, and the wiring electrode terminal portion 107 are formed by patterning the formed wiring electrode 108. The patterning is performed by forming an etching mask on an electrode film and removing unmasked portions of electrode material through etching.

Since the nozzle 101 is formed at the center of the electrode portion 108*a* of the wiring electrode 108, a portion of the wiring electrode 108 having no electrode film is formed concentric with the electrode portion 108*a*. The electrode portion 108*a* of the wiring electrode 108 covers the piezoelectric film 111.

Next, the protective film 113 is formed on the vibration plate 109, the wiring electrode 108, the shared electrode 106, and the insulating film 112. The protective film 113 is formed by depositing a solution containing a polyimide precursor through spin coating, and performing thermal polymerization and removal of the solution through baking. The protective film may be formed through spin coating, and thus a film having a smooth surface is formed. The protective film 113 may also be formed using any of various manufacturing methods such as CVD, vacuum deposition, plating, or spin on methods.

Next, patterning is performed to expose the shared electrode terminal portion 105 and the wiring electrode terminal portion 107 and to open the nozzles 101. When non-photosensitive polyimide is used for the protective film 113, patterning is performed by forming an etching mask on the non-photosensitive polyimide film and removing unmasked portions of the polyimide film through etching.

Next, a protective film cover tape is adhered onto the protective film 113. The pressure chamber structure 200 to which the protective film cover tape is adhered is inverted vertically, and the plurality of pressure chambers 201 are formed in the pressure chamber structure 200.

In detail, first, the protective film cover tape is attached onto the protective film 113. For example, the protective film cover tape is a rear surface protection tape for chemical mechanical polishing (CMP) of a silicon wafer.

An etching mask is formed on the pressure chamber structure 200 which is a silicon wafer, and the unmasked portions of the silicon wafer are removed using a so-called vertical deep dry etching method exclusively for a silicon substrate, and thus the pressure chambers 201 are formed.

For example, a halftone mask is used as the etching mask. The halftone mask includes a transmissive portion and a semi-transmissive portion. The semi-transmissive portion is provided at a position corresponding to the deformation control unit 505, and thus the pressure chambers 201 and the plurality of deformation control units 505 are formed by a single etching. In this manner, the deformation control units 505 are formed by etching the silicon wafer for forming the pressure chamber structure 200.

SF6 gas used for the above-mentioned etching does not have an etching effect on the $SiO_2$ film and the SiN film of the vibration plate 109 and the polyimide film of the protective film 113. For this reason, the progression of the dry etching of the silicon wafer for forming the pressure chambers 201 is stopped at the vibration plate 109.

Meanwhile, the above-described etching may use any of various methods such as a wet etching method using a chemical solution or a dry etching method using plasma. The etching method and the etching conditions may be changed using a material such as an insulating film, an electrode film, or a piezoelectric film. After an etching process using a photosensitive resist film is finished, the remaining photosensitive resist film is removed using a solution.

In addition, the deformation control unit 505 may be formed using methods other than etching. For example, after the pressure chambers 201 are formed by etching, the deformation control units 505 may be formed using a sputtering method. In this case, the deformation control unit 505 may be formed of a material—for example, $SiO_2$—which is different from the material of the pressure chamber structure 200.

Next, the separate plate 300 and the ink feed passage structure 400 are attached to the pressure chamber structure 200. That is, the separate plate 300, which is adhered to the ink feed passage structure 400, is adhered to the pressure chamber structure by using an epoxy resin agent.

Next, a cover tape is attached to the protective film 113 so as to cover the shared electrode terminal portions 105 and the wiring electrode terminal portions 107. The cover tape is formed of a resin, and can be easily desorbed from the protective film 113. The cover tape prevents dust and the ink-repellent film 116 to be described below from adhering to the shared electrode terminal portion 105 and the wiring electrode terminal portion 107.

Next, the ink-repellent film 116 is formed on the protective film 113. The ink-repellent film 116 is formed on the protective film 113 by spin coating a liquid ink-repellent film material. During the spin coating process, positive pressure air is injected from the ink supply port 401, so that the positive pressure air is discharged from the nozzles 101 connected to the ink supply passage 402. In this state, when the liquid ink-repellent film material is applied, the ink-repellent film material is prevented from adhering to inner walls of the nozzles 101.

After the ink-repellent film 116 is formed, the cover tape is peeled off from the protective film 113. Thereby, the ink jet head 10 shown in FIG. 3 is formed. The ink jet head 10 is mounted inside the ink jet printer 1. The driving circuit is then connected to the shared electrode terminal portions 105 and the wiring electrode terminal portions 107.

According to the ink jet printer 1 of the first embodiment, the deformation control units 505 surrounding the nozzle 101 protrude from the first surface 501 of the vibration plate 109 of the nozzle plate 100. The deformation control units 505 surround the nozzle, and thus there is a tendency for the deformation of the nozzle plate 100 through the actuator 102 to become uniform (i.e., symmetric) in the region surrounded by the deformation control units 505.

Specifically, the nozzle plate 100 is deformed by the actuator 102 as shown in FIG. 5. Non-uniform (i.e., asymmetric) deformation of the nozzle plate 100 occurs when, for example, a portion located on the right side of the nozzle 101 is deformed further than a portion located on the left side of the nozzle 101. The non-uniformity of the deformation is reduced by the stiffness of the deformation control units 505 surrounding the nozzle 101. Thereby, it is possible to prevent the deformation of the nozzle plate 100 from becoming non-uniform, and to prevent an ink discharge direction from becoming unstable.

The first surface 501 of the vibration plate 109 of the nozzle plate 100 applies pressure to the ink supplied to the pressure chambers 201. The deformation control units 505 are provided in the vibration plate 109, and thus non-uniform deformation of the nozzle plate 100 is prevented.

The deformation control units 505 are disposed inside the region D that is defined by the outer edge of the actuator 102. Accordingly, deformation of the nozzle plate 100 is made substantially uniform due to the deformation control units 505.

The annular width of the deformation control unit 505 is smaller than the annular width of the actuator 102. Thus, the deformation control unit 505 does not obstruct deformation of the nozzle plate 100 through the actuator 102.

The center of the deformation control unit 505 is aligned with the center of the nozzle 101. Thereby, the deformation of the nozzle plate 100 is uniform (i.e., symmetric) in a region centered around the nozzle 101. This arrangement prevents ink discharge from becoming unstable.

However, the center of each of the plurality of deformation control units 505 may be different from the center of the nozzle 101. In this case, the nozzle plate 100 is uniformly deformed by adjusting the position of each of the deformation control units 505.

Next, a second embodiment will be described with reference to FIG. 6. Components in the second embodiment having the same function as the ink jet printer 1 of the first embodiment are denoted by the same reference numerals. Further, the description of the component may be partially or totally omitted.

Figure 6:
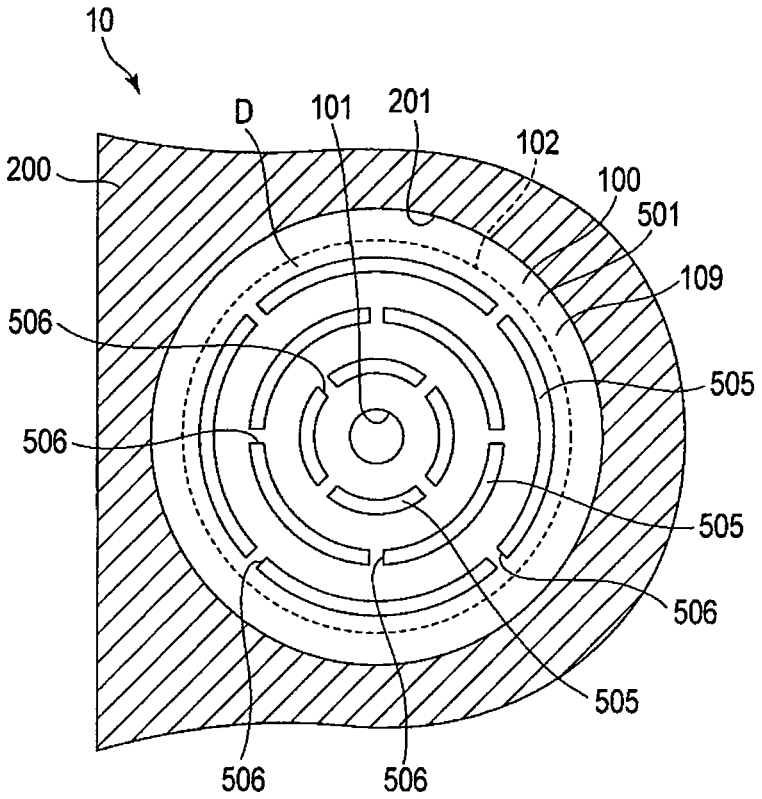
FIG. 6 is a cross-sectional view of a part of an ink jet head according to a second embodiment.

FIG. 6 is a cross-sectional view of a part of the ink jet head 10 according to the second embodiment. As shown in FIG. 6, a plurality of slits 506 are provided in the deformation control units 505 of the second embodiment. In other words, the plurality of deformation control units 505 are arc-like ribs that are adjacent to each other, separated by the slits 506.

The plurality of slits 506 are radially located around the nozzle 101. In other words, the plurality of slits 506 are located from an inner edge the deformation control unit 505 to an outer edge thereof. The slits 506 of an outer deformation control unit 505 are arranged alternately with the slits 506 of a deformation control unit 505 located inside the outer deformation control unit 505.

The depth of the slit 506 is equal to the thickness of the deformation control unit 505. In other words, in a portion where the slit 506 is provided, the deformation control unit 505 is removed. Thus the first surface 501 of the vibration plate 109 is exposed at each slit 506. However, the depth of the slit 506 is not limited thereto, and may be, for example, half the thickness of the deformation control unit 505.

According to the ink jet printer 1 of the second embodiment, the slits 506 are provided in the deformation control unit 505. Thereby, ink can pass through the slits 506, and thus it is possible to prevent the ink from pooling inside the deformation control unit 505.

Figure 7:
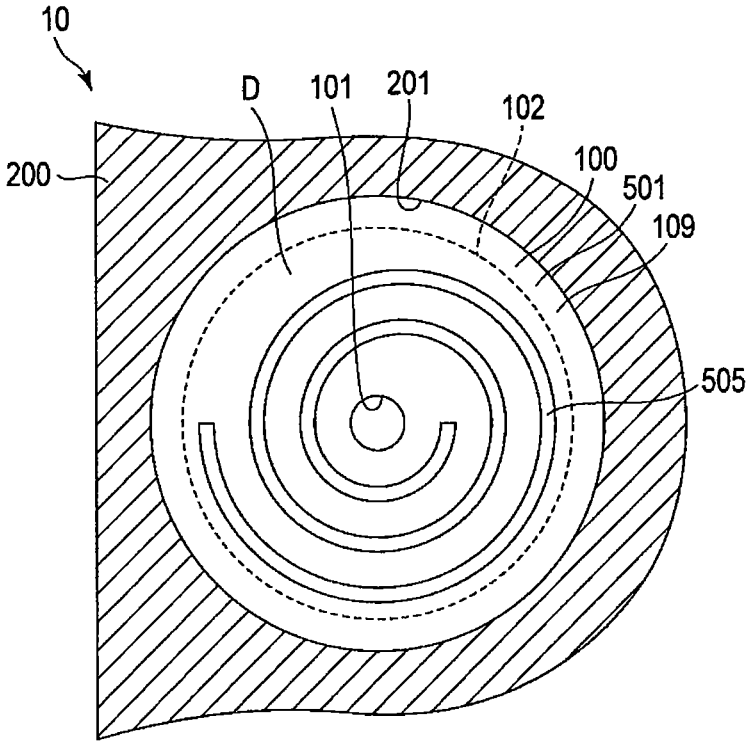
FIG. 7 is a cross-sectional view of a part of an ink jet head according to a third embodiment.

Next, a third embodiment will be described with reference to FIG. 7. FIG. 7 is a cross-sectional view of a part of the ink jet head 10 according to the third embodiment. As shown in FIG. 7, the deformation control unit 505 of the third embodiment is formed in a spiral shape. Thereby, it is possible for the ink to flow to the nozzle 101, and to prevent the ink from pooling inside the deformation control unit 505.

Figure 8:
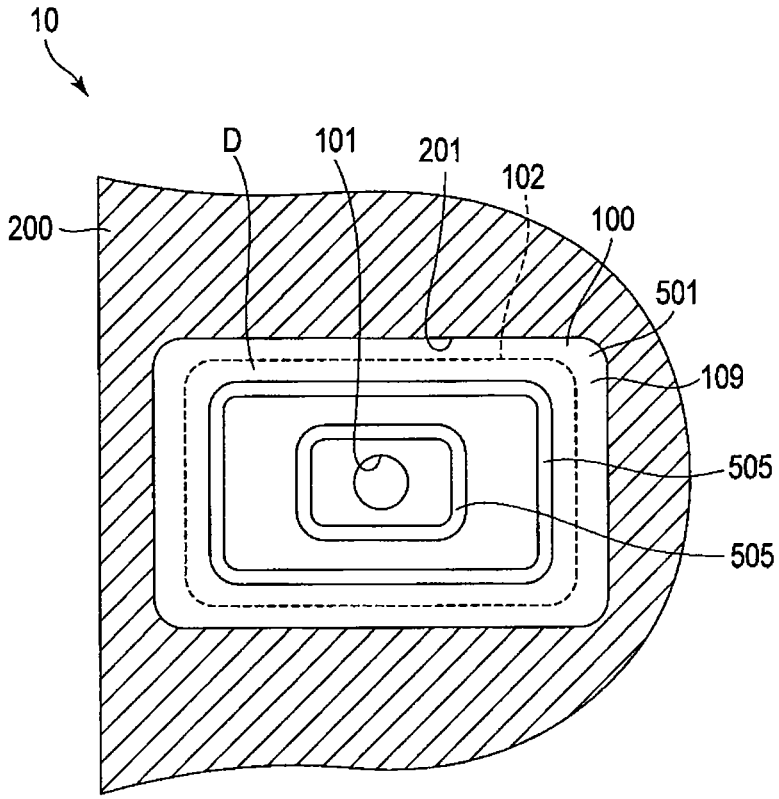
FIG. 8 is a cross-sectional view of a part of an ink jet head according to a fourth embodiment.

Next, fourth and fifth embodiments will be described with reference to FIG. 8 and FIG. 9. FIG. 8 is a cross-sectional view of a part of the ink jet head 10 according to the fourth embodiment. As shown in FIG. 8, the pressure chamber 201 of the fourth embodiment is formed in a rectangular shape. The actuator 102 and the deformation control units 505 correspond to the pressure chamber 201, and are also formed in a rectangular shape.

Figure 9:
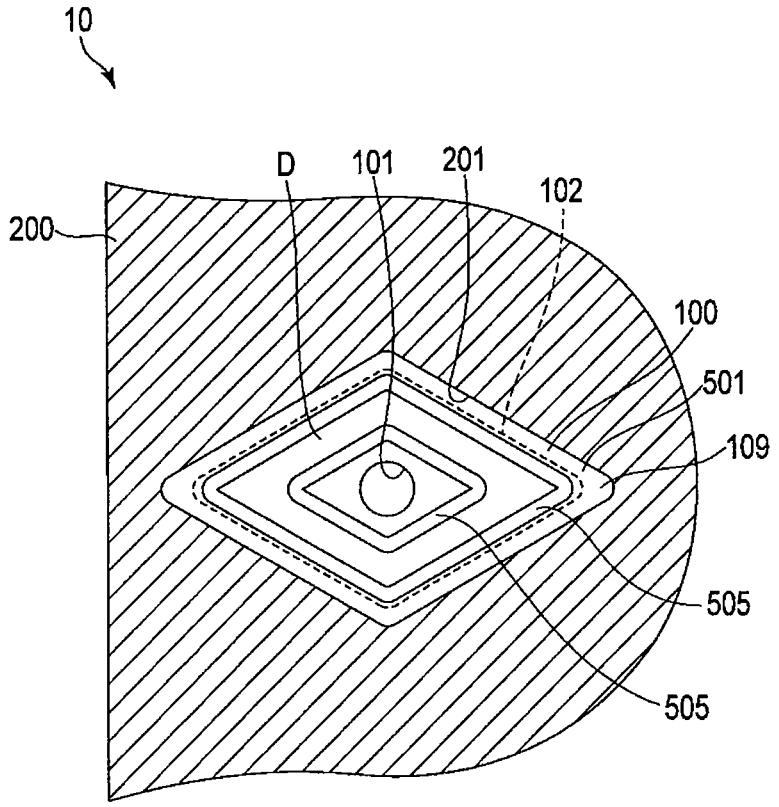
FIG. 9 is a cross-sectional view of a part of an ink jet head according to a fifth embodiment.

FIG. 9 is a cross-sectional view of a part of the ink jet head 10 according to the fifth embodiment. As shown in FIG. 9, the pressure chamber 201 of the fifth embodiment is formed in a rhombic shape. The pressure chamber 201 is formed in a rhombic shape, and thus there is a tendency for the nozzles 101 to be arranged in a zigzag manner. The actuator 102 and the deformation control unit 505 correspond to the pressure chamber 201, and are also formed in a rhombic shape.

In the fourth and fifth embodiments, the shapes of the actuator 102 and the deformation control unit 505 are similar to the shape of the pressure chamber 201. Meanwhile, the shapes of the actuator 102 and the deformation control unit 505 may be flat or inclined with respect to the shape of the pressure chamber 201.

The center of the deformation control unit 505 is aligned with the center of the nozzle 101. In other words, the shape of the actuator 102 is formed so as to be point-symmetrical with respect to the center of the nozzle 101.

As in the above-described embodiment, the deformation control unit 505 is not limited to an annular shape, and may have any of various shapes. Likewise, the shape of the deformation control unit 505 may be different from the shapes of the pressure chamber 201 and the actuator 102.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head comprising:

a substrate including a mounting surface and a pressure chamber open to the mounting surface;

a nozzle plate including an inner surface fixed to the mounting surface and covering the pressure chamber, a nozzle open to the pressure chamber, and a piezoelectric element surrounding the nozzle and configured to deform the nozzle plate to thereby change a volume of the pressure chamber; and a deformation control unit disposed on and extending from the inner surface of the nozzle plate and surrounding the nozzle, the deformation control unit configured to cause the deformation of the nozzle plate by the piezoelectric element to be substantially symmetric with respect to the nozzle.

2. The ink jet head according to claim 1, wherein:

the deformation control unit is disposed on the inner surface of the nozzle plate within a region defined by an outer edge of the piezoelectric element.

3. The ink jet head according to claim 2, wherein:

a distance between an inner edge of the deformation control unit and an outer edge of the deformation control unit is smaller than a distance between an inner edge of the piezoelectric element and an outer edge of the piezoelectric element.

4. The ink jet head according to claim 3, wherein a center of the deformation control unit is aligned with a center of the nozzle.

5. The ink jet head according to claim 1, wherein:

the deformation control unit includes at least one slit configured to permit ink to flow through the deformation control unit.

6. The ink jet head according to claim 1, wherein:

the deformation control unit has a shape of one of a spiral, a rectangle and a rhombus.

7. The ink jet head according to claim 1, wherein:

the deformation control unit includes at least a first deformation control unit and a second deformation control unit disposed outside of the first deformation control unit.

8. An ink jet head comprising:

a pressure chamber formed in a substrate having a mounting surface, the pressure chamber being open to the mounting surface;

a nozzle plate including an inner surface fixed to the mounting surface and covering the pressure chamber, a nozzle open to the pressure chamber, and a piezoelectric element surrounding the nozzle and configured to deform the nozzle plate to thereby change a volume of the pressure chamber;

a deformation control unit disposed on and extending from the inner surface of the nozzle plate and surrounding the nozzle, the deformation control unit configured to cause the deformation of the nozzle plate by the piezoelectric element to be substantially symmetric with respect to the nozzle; and a wiring electrode configured to supply a driving voltage to the piezoelectric element to thereby cause the piezoelectric element to deform.

9. The ink jet head according to claim 8, wherein:

the deformation control unit is disposed on the inner surface of the nozzle plate within a region defined by an outer edge of the piezoelectric element.

10. The ink jet head according to claim 9, wherein:

a distance between an inner edge of the deformation control unit and an outer edge of the deformation control unit is smaller than a distance between an inner edge of the piezoelectric element and an outer edge of the piezoelectric element.

11. The ink jet head according to claim 10, wherein a center of the deformation control unit is aligned with a center of the nozzle.

12. The ink jet head according to claim 8, wherein:

the deformation control unit includes at least one slit configured to permit ink to flow through the deformation control unit.

13. The ink jet head according to claim 8, wherein:

the deformation control unit has a shape of one of a spiral, a rectangle and a rhombus.

14. The ink jet head according to claim 8, wherein:

the deformation control unit includes at least a first deformation control unit and a second deformation control unit disposed outside of the first deformation control unit.

15. A method of forming an ink jet head comprising:

forming pressure chamber in a substrate having a mounting surface and a pressure chamber open to the mounting surface;

fixing an inner surface of a nozzle plate to the mounting surface in a position covering the pressure chamber, the nozzle plate having a nozzle open to the pressure chamber and a piezoelectric element surrounding the nozzle and configured to deform the nozzle plate to thereby change a volume of the pressure chamber; and forming a deformation control unit on and extending from the inner surface of the nozzle plate and surrounding the nozzle, the deformation control unit configured to cause the deformation of the nozzle plate by the piezoelectric element to be substantially symmetric with respect to the nozzle.

16. The method according to claim 15, wherein:

the deformation control unit is formed on the inner surface of the nozzle plate within a region defined by an outer edge of the piezoelectric element.

17. The method according to claim 16, wherein:

the deformation control unit is formed so that a distance between an inner edge of the deformation control unit and an outer edge of the deformation control unit is smaller than a distance between an inner edge of the piezoelectric element and an outer edge of the piezoelectric element.

18. The method according to claim 17, wherein:

the deformation control unit is formed so that a center of the deformation control unit is aligned with a center of the nozzle.

19. The method according to claim 15, wherein:

forming the deformation control unit includes forming at least one slit in the deformation control unit to permit ink to flow through the deformation control unit.

20. The method according to claim 15, wherein:

forming the deformation control unit includes forming at least a first deformation control unit and forming a second deformation control unit outside of the first deformation control unit.

* * * * *